United States Patent [19]

Thomson

[11] 4,111,141

[45] Sep. 5, 1978

[54] THREAD TENSIONER

[75] Inventor: James E. Thomson, Pleasant Lake, Mich.

[73] Assignee: Western Stamping Corporation, Jackson, Mich.

[21] Appl. No.: 754,013

[22] Filed: Dec. 23, 1976

Related U.S. Application Data

[62] Division of Ser. No. 589,552, Jun. 23, 1975, abandoned.

[51] Int. Cl.[2] ..... D05B 47/02

[52] U.S. Cl. ..... 112/254

[58] Field of Search ..... 112/254, 59, 97, 199; 226/195; 242/147 R, 153, 154, 156.2, 149

[56] References Cited

U.S. PATENT DOCUMENTS

| | | | |
|---|---|---|---|
| 2,609,772 | 9/1952 | Casas-Robert | 112/254 |
| 2,640,662 | 6/1953 | TeStrake | 242/154 |
| 2,838,250 | 6/1958 | Staurakis et al. | 226/195 X |
| 2,981,497 | 4/1961 | Schurich | 242/149 |
| 2,998,177 | 8/1961 | Romano | 226/195 X |
| 3,722,439 | 3/1973 | Newman | 112/254 |
| 3,738,298 | 6/1973 | Albrecht | 112/254 |
| 3,937,417 | 2/1976 | Guenther | 242/154 X |

*Primary Examiner*—Werner H. Schroeder
*Assistant Examiner*—Moshe I. Cohen
*Attorney, Agent, or Firm*—Harness, Dickey & Pierce

[57] ABSTRACT

A thread tensioner for a sewing machine has smooth flat, parallel plastic surfaces between which the thread is passed and which can be urged together with variable tension by a cam acting through a spring. One of the surfaces is a part of an inner wall of a box-like housing. The other surface is carried by a hollow block slidable in the housing and containing the spring, and into which the cam projects.

19 Claims, 9 Drawing Figures

THREAD TENSIONER

BACKGROUND OF THE INVENTION

This is a division, of application Ser. No. 589,552, filed June 23, 1975 now abandoned.

Satisfactory operation of sewing machines is dependent upon accurate adjustment of a thread tensioning device mounted on the machine in a position accessible to the operator. Adjustments must be made manually to accommodate threads of differing gauge and characteristics. The movement of the thread is intermittent, and each time it is started from rest, the static friction imposed by the tensioner must be overcome. Thereafter, however, the tension consists only of the lesser resistance imposed by the sliding friction of the moving thread. Thread tensioners for sewing machines are commonly provided with friction elements in the form of discs or plates which are urged together by a spring and between which the thread is passed. In some tensioners, the friction elements are rotatable discs, so that each time the thread starts, it can rotate the discs. The present invention has as one of its objects to provide an improved thread tensioner of extremely simple but effective and reliable construction and in which one of the friction elements is a part of the tensioner housing. A further object is to provide an improved thread tensioner which is suitable for use on toy sewing machines, where usage is more severe, and misadjustment is more common, than is the case with machines used by adults, but which functions to provide highly uniform tension on the thread, and includes a calibratable adjusting device which permits desired settings to be reestablished without trial and experimentation. A further object is to provide such a thread tensioner which is highly foolproof and cannot be readily or accidentally disassembled, as often occurs with conventional constructions either during attempts to make an adjustment or, in the case of toy sewing machines, by a child acting from frustration or lack of sophistication or experience. The overall object of the invention, therefore, is to provide an improved, inexpensive, accurate and reliable adjustable thread tensioning device.

Other objects and advantages will become apparent upon consideration of the present disclosure in its entirety.

BRIEF DESCRIPTION OF THE FIGURES OF DRAWING

DETAILED DESCRIPTION OF THE PREFERRED FORM OF THE INVENTION

Figure 1:
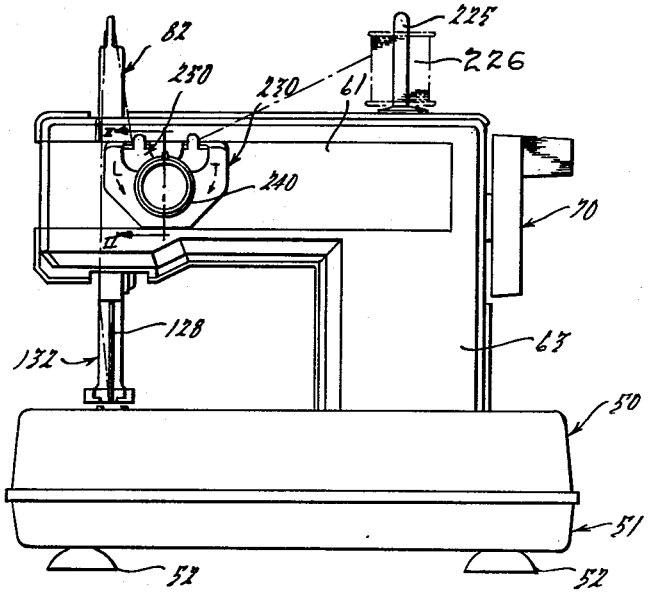
FIG. 1 is a front elevational view of a toy sewing machine provided with a thread tensioner incorporating the principles of the present invention.
Figure 6:
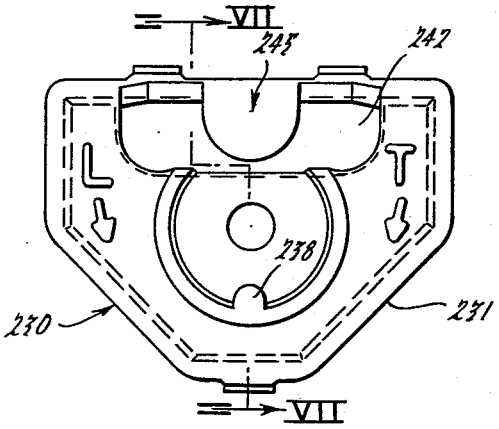
FIG. 6 is an enlarged front elevational view of the thread tensioner housing.
Figure 7:
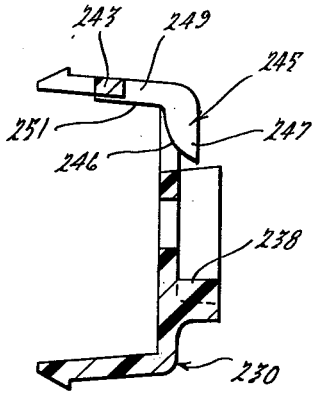
FIG. 7 is a sectional elevational view of the thread tensioner housing, taken substantially as indicated by the line and arrows VII—VII of FIG. 6 are looking in the direction of the arrows.
Figure 5:
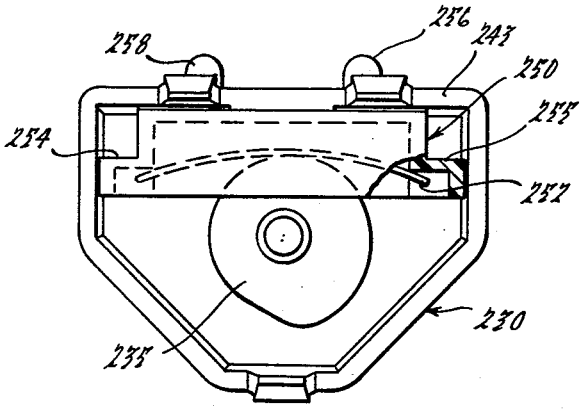
FIG. 5 is a rear elevational view of the thread tensioner with a portion of the friction block broken away.

FIG. 1 illustrates a toy sewing machine incorporating the improved tensioning device of the present invention. The details of the sewing machine are not involved in the present invention, although the construction of the machine may be as disclosed in U.S. patent application Ser. No. 741,765, filed Nov. 15, 1976, now abandoned.

Figure 2:
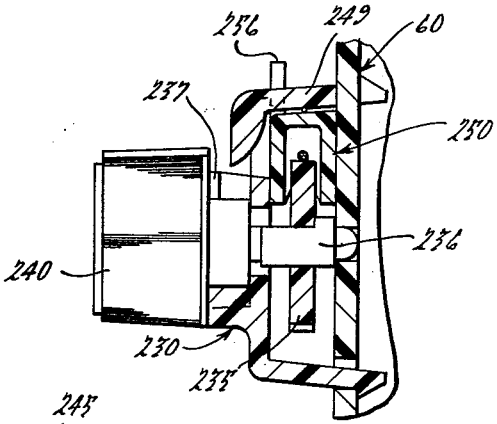
FIG. 2 is a vertical sectional elevational view of the thread tensioner on a larger scale, taken substantially on the II—II of FIG. 1 and looking in the direction of the arrows.
Figure 3:
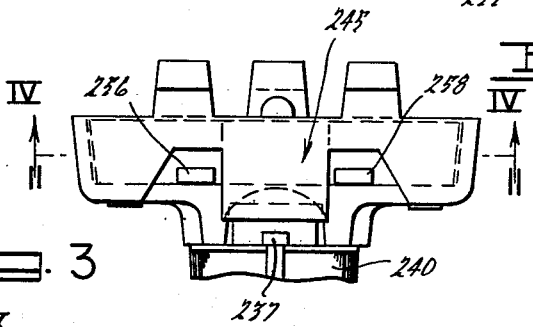
FIG. 3 is a top plan view of the same removed from the machine and with the adjusting knob partly broken away.
Figure 8:
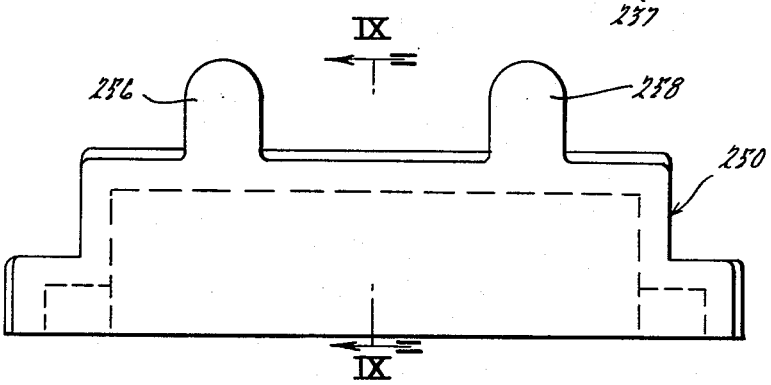
FIG. 8 is a greatly enlarged front elevational view of the friction block.
Figure 9:
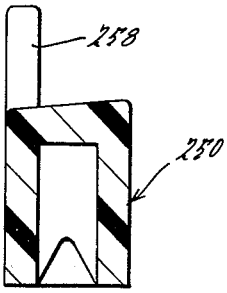
FIG. 9 is a vertical section taken substantially on the line IX—IX of FIG. 8 and looking in the direction of the arrows.
Figure 4:
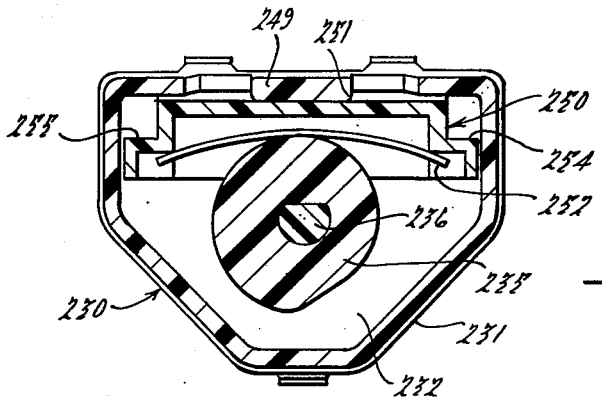
FIG. 4 is a sectional elevational view taken substantially on the line IV—IV of FIG. 3 and looking in the direction of the arrows.

The thread, which will be contained on a conventional pool 226 on the spool post 225 upstanding from the top of the machine, is conducted to a thread-tensioning device secured to the front upper housing portion 61. The thread-tensioning device, which is generally designated 230, consists of a plastic housing 231 of generally shallow box form having its open face lying against the flat front of the upper casing portion 61 to define an enclosure 232 within which is a plastic cam 235 which acts as a tension adjusting member, having an external surface of modified spiral form and which is keyed on a plastic shaft 236 journaled in the tensioner housing 231 and in the front wall of housing member 60. The shaft and cam are rotatable by means of a knob 240 projecting from the front of the tensioner housing. A relatively large cutout opening 242 located partly in the front wall and partly in the top wall of the housing 231 extends transversely a substantial proportion of the transverse dimension of the housing 231. An integral combined thread guide finger and friction element 245 formed as a forwardly and downwardly hooked extension of the top wall of the housing 231 overlies the top and front portions of the opening 242 but does not extend all the way to the bottom of the front portion of the opening. The inner surface 246 of the depending front leg 247 of the finger 245 is of smoothly-finished partly spherical form. The more nearly horizontal top leg 249 of the finger is somewhat thicker than the remainder of the top wall of housing 231, and the bottom of leg part 249 is smooth, flat and at its side edges is rounded at the bottom, as indicated 251, defining a friction portion for the thread. Vertically slidable within the housing 231 is a friction block generally designated 250 which in fore and aft cross section is of inverted U-form, as indicated in FIGS. 28 and 32. The friction block 250 has a smooth flat top surface which is urged toward the bottom surface of the leg part 249 and against an interposed thread, as shown in FIG. 2, by the cam 235 acting through a wire spring 252 trapped in pockets defined by laterally projecting extension and guiding portions 254, 255 at the ends of the friction block 250. A pair of cars 256, 258 extend upwardly from the front wall of the friction block 250 through the opening 242 and project above the top wall 243 of the casing 231 at positions laterally spaced from the guide finger 245. The tension with which the block 250 is urged toward the top wall 243 is variable by rotating the cam 235 by means of a handle in the form of a knob 240. The knob 240 is secured to the shaft as by cement and the cam and shaft are of course trapped in the housing 231. The knob has a lug 237 engageable with a stop 238 on housing 231 to limit rotation of the cam to slightly less than 360°. This not only prevents separation and possible loss of the parts of the tensioner, but desirable limits are thereby established as to the tightness and looseness of the stitching action of the machine.

The thread is trained from the spool and hooked beneath the finger 245, then pulled up and passed through the eye (undesignated) at the upper end of the needle bar 82. The tensioner housing 231 and friction block 250 are formed of a strong, wear resistant acetal resin plastic having low friction characteristics. Such a plastic is sold under the trademark "Delrin" by E. I. DuPont de Nemours & Co. During the threading operation the thread moves rearwardly under the hook-like guide finger 245 to the rear of the cutout opening 246 and behind the fingers 256, 258 so that the thread is substantially centered on top of the tension block, between the tension block and the lower surface of the finger as shown in FIG. 2.

From the eye in the needlebar the thread is run downwardly to the eye in the point of the needle 128, through which the thread is passed then trained under the presser foot 132 in the conventional manner.

It will be recognized that the "Delrin"-type material from which the principal working parts are formed, although having great strength and wear resistance, also has a very low coefficient of friction, as noted, and the disclosed construction functions effectively due to the fact that the thread accelerates easily from rest, and the tension can be set high enough to maintain a good stitching action without thereby creating an amount of static friction which would impose undue resistance at startup.

This Detailed Description of Preferred Form of the Invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent Office.

What is claimed is:

1. A thread tensioner for a sewing machine comprising a box-like housing having a front wall and a top wall and having a transversely extending opening extending forwardly in the top wall from a position spaced rearwardly from the front wall, said opening continuing uninterruptedly part way down the front wall, a guide finger integral with the housing and having a top portion having a smooth bottom surface and extending forwardly from a mid portion of the rear margin of the opening in the top wall substantially parallel to the top wall and having a depending portion extending downwardly and forwardly part way in the opening in the front wall to a position outspaced from the front wall, the sides of said finger being spaced from both lateral ends of the opening, a friction block in the housing having a smooth top whereby the mid portion of a thread can be hooked under the finger and moved upwardly and rearwardly over the block to a position interposed between the top of the block and the bottom surface of such top portion of the finger, and means for yieldably urging the block upwardly against a thread in such interposed position.

2. A thread tensioner for a sewing machine comprising a box-like housing having a front wall and a top wall and having a transversely extending opening extending forwardly in the top wall from a position spaced rearwardly from the front wall, said opening continuing uninterruptedly at least part way down the front wall, a guide finger integral with the housing and having a top portion having a smooth bottom surface and extending forwardly from a mid portion of the rear margin of the opening in the top wall substantially parallel to the top wall and having a depending portion extending downwardly and forwardly at least part way in the opening in the front wall, the sides of said finger being spaced from both lateral ends of the opening, a friction block in the housing having a smooth top, whereby the mid portion of a thread can be hooked under the finger and moved upwardly and rearwardly over the block to a position interposed between the top of the block and the bottom surface of such top portion of the finger, and tension means for yieldably urging the block upwardly against a thread in such interposed position.

3. A thread tensioner as defined in claim 2 wherein the depending portion of the guide finger is of smoothly rounded form in both the vertical and horizontal planes on its side which faces away from the front wall.

4. A thread tensioner as defined in claim 3 wherein at least the lowest extremity of said guide finger is located forwardly of the frontal plane of the front wall.

5. A thread tensioner according to claim 2 including a resilient spring portion engageable with the block on the side thereof opposite the top portion of the finger, and a cam engageable with said spring portion and adjustable to vary the force with which the block is urged toward the finger.

6. A thread tensioner according to claim 5 wherein the block is of substantially inverted U-cross section, the cam being a flat cam projecting upwardly into the block between the side webs of the inverted U and having a peripheral edge surface varying in its radial dimension, a thrust spring portion interposed between said cam edge surface and the block, and a handle connected to the cam to rotate the same to vary the thrust on the spring and block.

7. In a thread tensioner according to claim 6, stop means carried by said housing and handle and interengageable to define limits to the range of adjustment of the force with which the block is urged toward the finger.

8. A thread tensioner according to claim 2 in which the cam and block are interfitted with each other within the housing and said bottom surface of the top portion of the finger and the top surface of the block are substantially flat.

9. A thread tensioner according to claim 2 wherein the finger and block are formed of plastic and said surfaces are substantially flat.

10. In a thread tensioner according to claim 2, a pair of thread guiding ears projecting upwardly from the block through the top portion of the opening on either side of and laterally spaced from the finger.

11. In a thread tensioner according to claim 2, means for varying the force with which the block is urged upwardly, and means limiting the range of such variation.

12. In a thread tensioner according to claim 2, a cam movable to urge the block upwardly with varying force, and stop means limiting the range of movement of the block and thereby limiting the range of tension adjustment.

13. A thread tensioner as defined in claim 2 wherein said block and the means for urging it upwardly are held by the housing against removal therefrom.

14. A thread tensioner according to claim 2 including means for adjusting the tension of said last named means, characterized in that the block, cam and adjusting means are held by the housing against removal therefrom.

15. A thread tensioner for a sewing machine, comprising a housing having a smooth internal wall portion, a friction block in the housing movable toward and from said wall portion and having a smooth surface facing said wall portion, means for urging said block toward said wall portion to impose friction upon a thread interposed between said wall portion and said surface, said housing having a thread-receiving opening communicating with the space between said surface and wall portion, said means including a spring and a movable adjustment member for variably tensioning the spring to vary the friction imposed on the thread.

16. In a thread tensioner as defined in claim 15, means limiting the movement of said member to a preset range of adjustment.

17. A thread tensioner as defined in claim 16 wherein said spring and member are retained in said housing, said member having a rotatable camming surface for varying the tension of the spring in response to rotation of said member.

18. In a thread tensioner for a sewing machine, a generally box-like housing having a wall formed of an acetal resin having a low coefficient of friction, said wall having a smooth surface facing the interior of the housing, a friction block in the housing formed of a similar resin having a low coefficient of friction and having a smooth surface facing toward and conforming to the shape of the first mentioned surface and movable to and from the first mentioned surface to confine a thread between said surfaces and exert frictional drag thereon, and means yieldably urging said block toward the wall.

19. Means as defined in claim 18 wherein the block has a chamber therein open on its side facing away from said surfaces, a spring in the chamber reacting against the block and a cam journaled in the housing, projecting into the chamber and bearing against the spring to variably tension the spring in a direction to urge the block toward the first mentioned surface.

* * * * *

UNITED STATES PATENT AND TRADEMARK OFFICE

CERTIFICATE OF CORRECTION

PATENT NO. : 4,111,141

DATED : September 5, 1978

INVENTOR(S) : James E. Thomson

It is certified that error appears in the above-identified patent and that said Letters Patent are hereby corrected as shown below:

Column 2, line 1, "are" should be --and--. Column 2, lines 16 and 17, delete "abandoned" and insert --Patent No. 4,079,684 issued March 21, 1978--. Column 2, line 19, "pool" should be --spool--. Column 2, line 48, after "indicated" insert --at--. Column 2, line 58, "cars" should be --ears--.

Signed and Sealed this

*Tenth* Day of *July 1979*

[SEAL]

*Attest:*

*Attesting Officer*

LUTRELLE F. PARKER

*Acting Commissioner of Patents and Trademarks*